US006747233B1

(12) United States Patent
Glinkowski

(10) Patent No.: US 6,747,233 B1
(45) Date of Patent: Jun. 8, 2004

(54) NON-LINEAR MAGNETIC FIELD DISTRIBUTION IN VACUUM INTERRUPTER CONTACTS

(75) Inventor: Mietek T. Glinkowski, Raleigh, NC (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 10/040,858

(22) Filed: Dec. 28, 2001

(51) Int. Cl.[7] ..... H01H 33/66
(52) U.S. Cl. ..... 218/123; 218/130
(58) Field of Search ..... 218/118, 123–128, 218/129, 130, 120, 140, 154

(56) References Cited

U.S. PATENT DOCUMENTS

| | | | | |
|---|---|---|---|---|
| 3,327,081 | A | 6/1967 | Pflanz | |
| 3,462,572 | A | 8/1969 | Sofianek | |
| 3,485,978 | A | 12/1969 | Grindell | |
| 3,626,124 | A | 12/1971 | Denes | |
| 3,711,665 | A | 1/1973 | Dethlefsen | |
| 3,740,507 | A | 6/1973 | Kuhl et al. | |
| 4,260,864 | A | 4/1981 | Wayland et al. | |
| 4,390,762 | A | 6/1983 | Watzke | |
| 4,401,868 | A | 8/1983 | Wootton et al. | |
| 4,695,688 | A | 9/1987 | Farrall et al. | |
| 4,727,228 | A | 2/1988 | Hoene et al. | |
| 4,935,588 | A | 6/1990 | Hess et al. | |
| 5,461,205 | A | 10/1995 | Schulman | |
| 5,691,522 | A | 11/1997 | Schulman et al. | |
| 6,080,952 | A * | 6/2000 | Okutomi et al. | 218/118 |
| 6,376,791 | B1 * | 4/2002 | Watanabe et al. | 218/123 |

FOREIGN PATENT DOCUMENTS

| | | |
|---|---|---|
| JP | 09-053328 | 2/1997 |
| JP | 10-255605 | 9/1998 |
| JP | 10-321093 | 12/1998 |

* cited by examiner

*Primary Examiner*—Lincoln Donovan
(74) *Attorney, Agent, or Firm*—Woodcock Washburn LLP

(57) ABSTRACT

Novel interrupter assembly designs utilizing saturable magnetic materials are disclosed and described. In certain embodiments of the invention the saturable magnetic materials are placed in the interrupter contact body and/or electrode. The inclusion of saturable magnetic materials in the interrupter assembly results in the redistribution of the magnetic flux within the interrupter contact assembly appropriate for the electrical current conditions being experienced within the assembly at any moment in time.

8 Claims, 4 Drawing Sheets

NON-LINEAR MAGNETIC FIELD DISTRIBUTION IN VACUUM INTERRUPTER CONTACTS

I. BACKGROUND

A. Field of the Invention

This invention relates generally to the devices for interrupting electrical currents and more specifically to contact assemblies for use in circuit breaker assemblies.

B. Description of the Related Art

In the field of circuit breakers many power vacuum interrupter contacts rely on axial magnetic fields (AMFs) to accomplish interruption of high short circuit currents. In these designs the AMF strength typically is directly proportional to the amount of current flowing through the contacts. As a result, a common failure mode for current interrupter assemblies results from the concentration of the AMFs at the center of the interrupter electrode. When the AMFs concentrate sufficiently at the center of the electrode, the vacuum arc constricts in the center of the electrode as well. The interruptor assemblies therefore fail at the current zero. However, a higher relative AMF strength is needed for smaller currents to be properly interrupted.

Accordingly, there is a need for a contact design where sufficiently large magnetic field strengths are created at lower current levels to interrupt the currents when necessary while also preventing the concentration of the AMFs in the center of the interrupter electrodes at higher current levels.

II. SUMMARY OF THE INVENTION

The invention meets the foregoing need by utilizing saturable magnetic materials in the interrupter assembly. In certain embodiments of the invention the saturable magnetic materials are placed in the interrupter contact body and/or electrode. Because the saturable magnetic materials exhibit a non-linear magnetic field strength in response to changes in electric current, the inclusion of saturable magnetic materials in the interrupter assembly results in the redistribution of the magnetic flux within the interrupter contact assembly appropriate for the electrical conditions being experienced within the assembly at any moment in time. In other words, unlike the prior art, the magnetic field strength in the inventive interruptor assembly responds in a non-linear relationship vis-à-vis the current flowing through the assembly.

The invention may reside in any number of forms, including an interrupter assembly comprising a contact having a center and an outer edge, the contact comprising a combination of electrically conductive material and magnetic materials, the magnetic materials arranged within the contact so that an axial magnetic field produced in the contact under relatively low current conditions has a substantially constant strength from the contact center to the contact outer edge.

The invention may also be in the form of an interruptor assembly comprising a contact having a center and an outer edge, the contact comprising a combination of electrically conductive material, a first magnetic material, and a second magnetic material, the first magnetic material located near the contact outer edge and having a high magnetic saturation point and a high magnetic permeability, the second magnetic material located near the contact center and having a low magnetic saturation point and a low magnetic permeability.

Yet another form the invention may take is an interruptor assembly comprising a contact having a center and an outer edge, the contact comprising a combination of electrically conductive material, a first magnetic material, and a second magnetic material, the first magnetic material located near the contact outer edge and having a high magnetic saturation point and a low magnetic permeability, the second magnetic material located near the contact center and having a low magnetic saturation point and a high magnetic permeability.

III. BRIEF DESCRIPTION OF THE DRAWINGS

These and other features, aspects, and advantages of the invention will become better understood in connection with the appended claims and the following description and drawings of various embodiments of the invention where:

IV. DETAILED DESCRIPTION OF THE PREFERRED EMBODIMENTS

Throughout the following detailed description similar reference numbers refer to similar elements in all the figures of the drawings.

First Embodiment

Figure 1A:
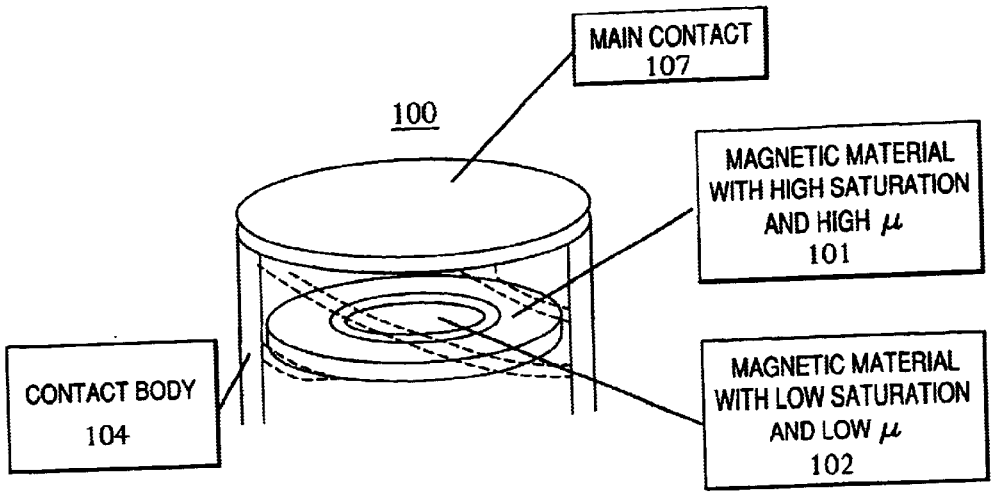
FIGS. 1A and 1B depict first embodiments of the invention.
Figure 1B:
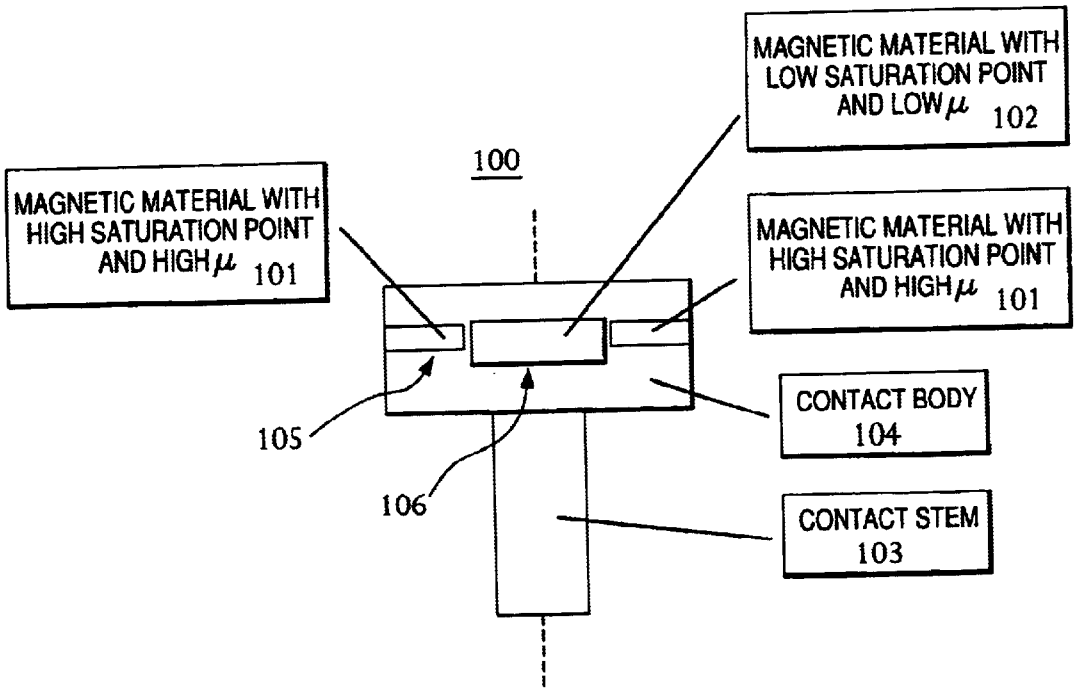

FIGS. 1A and 1B depict first embodiments of the invention in the context of an interruptor assembly contact 100. Contact 100 comprises a contact stem 103 integrally attached to a contact body 104, meaning that contact 100 may be formed from stem 103 and body 104 in any number of ways as will be understood by one skilled in the art. For instance, contact 100 may be of a unitary construction having the form of stem 103 and body 104, stem 103 and body 104 may comprise separate pieces that are joined together in a suitable manner to form contact 100, and the like. In any event, contact stem 103 and contact body 104 substantially comprise electrically conducting material(s). The upper portion 107 of contact body 104 is typically referred to as the main contact.

The contact body 104 portion of contact 100 in the first embodiment further comprises a combination of magnetic materials 101 and 102. Magnetic material 101 is in annular in form and located toward the outer circumferential edge 105 of contact body 104. Magnetic material 101 has a high magnetic saturation point and high magnetic permeability, $\mu_r$. Magnetic material 102 on the other hand is in the form of a solid disc located in and about the center 106 of contact body 104, and has a low magnetic saturation point and low magnetic permeability, $\mu_r$.

The operation of contact 100 is as follows. When current is flowing through contact 100 the overall magnetic field distribution within contact 100 is modified due to the presence of magnetic materials 101 and 102. At low contact and arc currents, where the AMF is sufficient in the center of contact 100 to keep the arc diffuse but not sufficient or even zero at the edges of contact 100, magnetic material 101 attracts and magnifies the magnetic field at the edges due to its high $\mu_r$. At higher current levels when the arc has a tendency to concentrate in the center of contact 100 due to otherwise high AMFs, which may cause significant damage to the contact 100 and result in the failure to interrupt current when necessary, magnetic material 102 saturates. Magnetic material 102 saturating at higher current levels in turn causes AMFs to dampen, thereby preventing the arc from concentrating in the center of contact 100 and becoming constricted.

Figure 2:
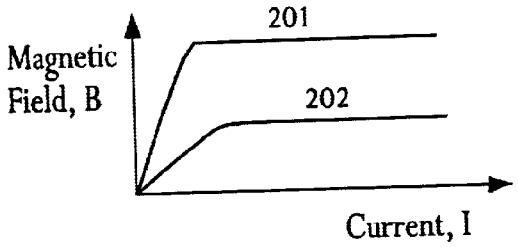
FIG. 2 depicts the magnetic field strength in certain magnetic materials within the first embodiment of the invention as a function of current level.

FIG. 2 depicts the magnetic field strength, B, in magnetic materials 101 and 102 as a function of increasing current level, I. Plot 201 depicts the magnetic field strength in magnetic material 101 as the magnitude of the current passing through it increases. Plot 202 depicts the magnetic field strength in magnetic material 102 as the magnitude of the current passing through it increases. Note that in both magnetic material 101 and 102 the magnetic fields increase at first as the magnitude of the current increases, but at different rates, the difference in rates being due to the different magnetic permeabilities. The magnetic fields in materials 101 and 102 ultimately level off and remain at nearly constant (although different) values despite larger and larger amounts of current passing through the materials.

Figure 3:
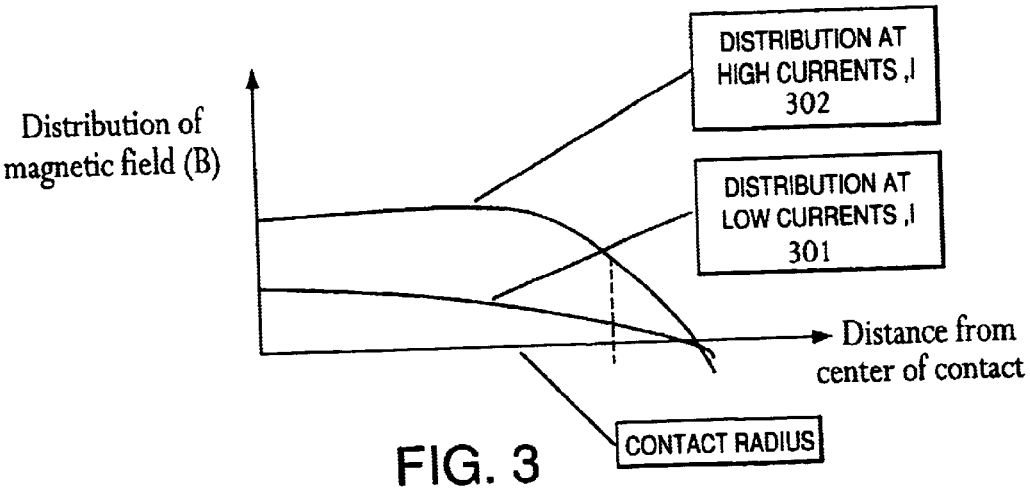
FIG. 3 depicts exemplary magnetic flux distributions within the first embodiment of the invention under various current conditions.

FIG. 3 depicts exemplary AMF flux distributions within the first embodiment of the invention under higher and lower arc current conditions. Plot 301 depicts the AMF strength versus distance from the center of contact 100 at lower relative current levels. Plot 302 depicts the AMF strength versus distance from the center of contact 100 at higher relative current levels. Note that the AMF in contact 100 is a relatively constant value as distance increases from the center of contact 100 until a point near the contact 100 radius (i.e., outer circumferential edge 105 above) is reached where the AMF strength drops off towards a zero value—slowly in the presence of lower relative current levels and rapidly in the presence of higher relative current levels. Note also that the increase of AMF from plot 301 (at lower current levels) to plot 302 (at high currents) is relatively smaller at the center than at a distance from the center. This is due to the combined action of the two different magnetic materials 101 and 102.

Second Embodiment

Figure 4A:
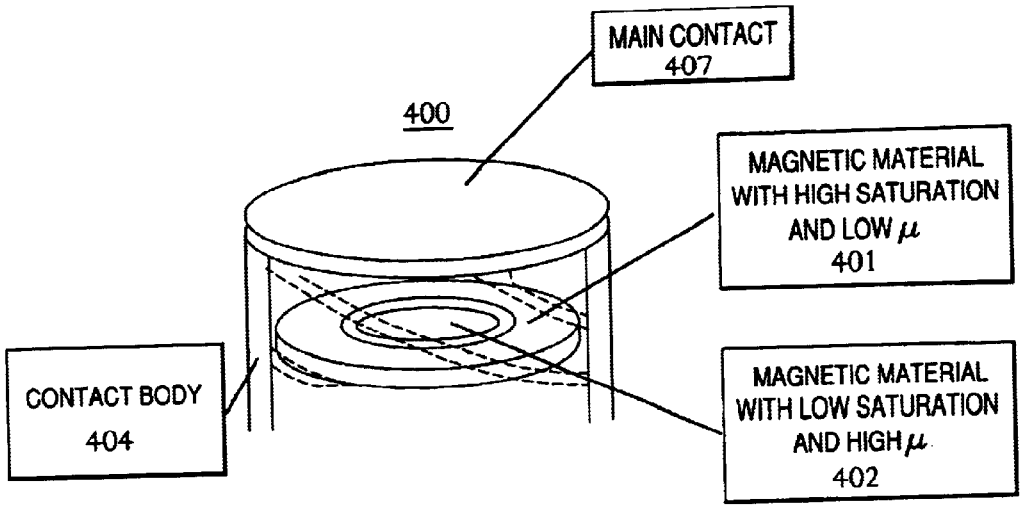
FIGS. 4A and 4B depict second embodiments of the invention.
Figure 4B:
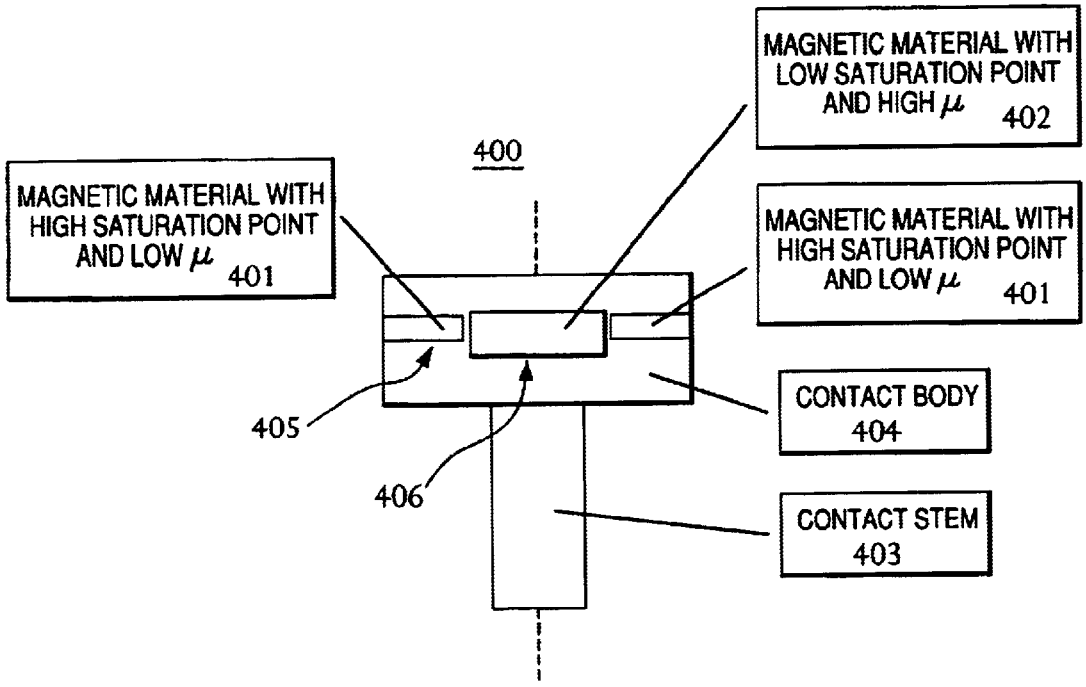

FIGS. 4A and 4B depict second embodiments of the invention in the context of an interruptor assembly contact 400. Contact 400 comprises a contact stem 403 integrally attached to a contact body 404, meaning that contact 400 may be formed from stem 403 and body 404 in any number of ways as will be understood by one skilled in the art. For instance, contact 400 may be of a unitary construction having the form of stem 403 and body 404, stem 403 and body 404 may comprise separate pieces that are joined together in a suitable manner to form contact 400, and the like. In any event, contact stem 403 and contact body 404 substantially comprise electrically conducting material(s). The upper portion 407 of contact body 404 is typically referred to as the main contact.

The contact body 404 portion of contact 400 in the second embodiment further comprises a combination of magnetic materials 401 and 402. Magnetic material 401 is annular in form and located toward the outer circumferential edge 405 of contact body 404. Magnetic material 401 has a high magnetic saturation point and a low magnetic permeability, $\mu_r$. Magnetic material 402 on the other hand is in the form of a solid disc located in and about the center 406 of contact body 404, and has a low magnetic saturation point and a high magnetic permeability, $\mu_r$.

The operation of contact 400 is as follows. When current is flowing through contact 400 the overall magnetic field distribution within contact 400 is modified due to the presence of magnetic materials 401 and 402 even more than with design of the first embodiment of the invention. At low and moderate relative contact and arc current levels the AMFs are concentrated towards the center of contact 400 due to the high permeability of magnetic material 402. In this way the performance of the interrupter assembly may be improved for high reliability switching operations where, for example, very low contact restrike level is required. One such application is capacitor switching. The presence of magnetic material 402 confines the diffuse arc towards the center of contact 400 at low and moderate current levels (for normal load switching of the capacitor banks), thus the expansion of the arc plasma outside the main contact area is limited and the probability of restrikes is significantly reduced. At high relative current levels magnetic material 402 saturates and no longer concentrates the AMFs and the arc in and about the center of contact 400. Rather, magnetic material 401 begins to play the dominant part in shaping the AMF flux distribution, enhancing the magnetic field at the outer circumferential edges 405 of contact 400. In other words, at higher relative current levels the presence of magnetic material 401 equalizes the distribution of the arc plasma and ensures that it remains diffuse. The highly non-linear distribution of the magnetic field strength at higher relative current levels effectively compensates the pinch effect of the arc current.

Figure 5:
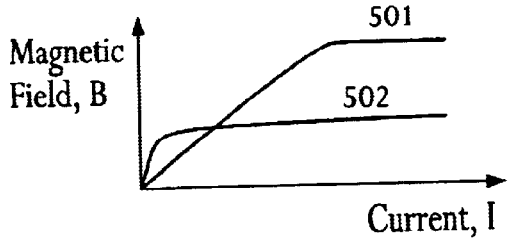
FIG. 5 depicts the magnetic field strength in certain magnetic materials within the second embodiment of the invention as a function of current level.

FIG. 5 depicts the magnetic field strength, B, in magnetic materials 401 and 402 as a function of increasing current level, I. Plot 501 depicts the magnetic field strength in magnetic material 401 as the magnitude of the current passing through it increases. Plot 502 depicts the magnetic field strength in magnetic material 402 as the magnitude of the current passing through it increases. Note that in magnetic material 402 the magnetic field strength increases sharply but then quickly levels off and remains at a nearly constant value despite larger and larger amounts of current. In magnetic material 401 though, the magnetic field strength increases slowly and substantially linearly to a point where it then levels off and remains at nearly constant level despite the presence of more and more current. Unlike the first embodiment, the current level at which the magnetic field strength no longer increases despite the presence of more current is much higher for the outer, annular shaped magnetic material that for the inner, disc shaped magnetic material.

Figure 6:
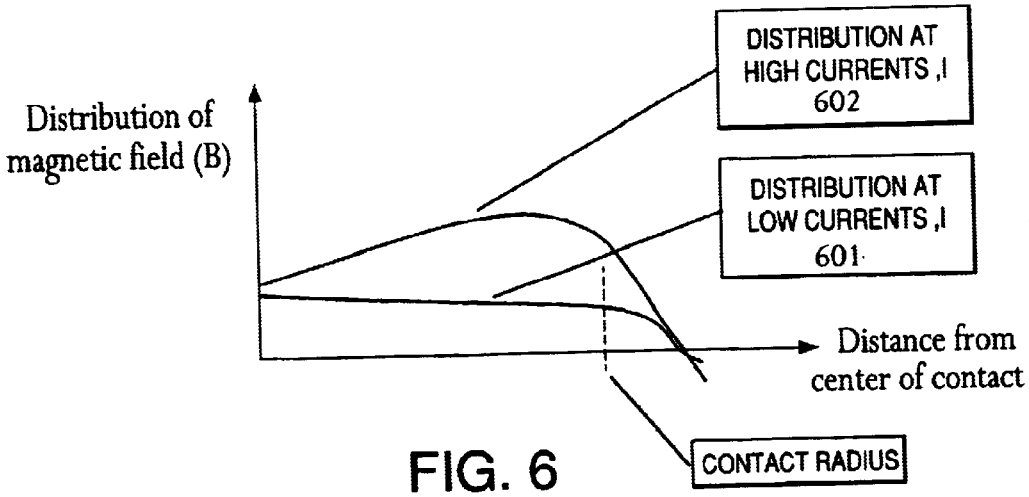
FIG. 6 depicts exemplary magnetic flux distribution with the second embodiment of the invention under various current conditions.

FIG. 6 depicts exemplary AMF flux distributions within the second embodiment of the invention under higher and lower arc current conditions. Plot 601 depicts the AMF strength versus distance from the center of contact 400 at lower relative current levels. Plot 602 depicts the AMP strength versus distance from the center of contact 400 at higher relative current levels. Note that the AMF strength under low current conditions in contact 400 is a relatively constant value as distance increases from the center of contact 400 until a point near the contact radius (i.e., outer circumferential edge 405 above) is reached where the AMF strength slowly drops off towards a zero value. The ANF strength under higher current conditions however gradually becomes stronger as distance from the center of contact 400 until a point near the contact radius is reached where the field strength ceases to increase and then rapidly drops off towards a zero value.

Conclusion

While the invention has been described in connection with the embodiments depicted in the various figures and appendices, it is to be understood that other embodiments may be used or modifications and additions may be made to the described embodiments without deviating from the spirit of the invention. Therefore, the invention should not be limited to any single embodiment whether depicted in the figures or not. Rather, the invention should be construed to have the full breadth and scope accorded by the claims appended below.

I claim:

1. A contact for an interrupter assembly comprising:

(a) an electrically conductive material having a center, an outer edge, a top, and a bottom;

(b) a first magnetic material having a high magnetic saturation point, the first magnetic material being located within the electrically conductive material between the top and the bottom and in closer proximity to the outer edge than the center of the electrically conductive material; and (c) a second magnetic material having a low magnetic saturation point, the second magnetic material being located within the electrically conductive material between the top and the bottom and in closer proximity to the center than the outer edge of the electrically conductive material.

2. The contact of claim 1 wherein the first magnetic material has a high magnetic permeability and the second magnetic material has a low magnetic permeability.

3. The contact of claim 1 wherein the first magnetic material is located substantially outside the second magnetic material relative to the center of the electrically conductive material.

4. The contact of claim 1 wherein there is no physical contact between the first and second magnetic materials.

5. A contact for an interrupter assembly comprising:

(a) a body and a stem formed of an electrically conductive material, the body having a center, an outer edge, a top, and a bottom, and the stem being integrally attached to the body bottom;

(b) a first magnetic material having a high magnetic saturation point, the first magnetic material being located within the body between the top and bottom and in closer proximity to the outer edge than the center of the body; and (c) a second magnetic material having a low magnetic saturation point, the second magnetic material being located within the body between the top and the bottom and in closer proximity to the center of the body than the outer edge of the body.

6. The contact of claim 5 wherein the first magnetic material has a high magnetic permeability and the second magnetic material has a low magnetic permeability.

7. The contact of claim 5 wherein the first magnetic material is located substantially outside the second magnetic material relative to the center of the body.

8. The contact of claim 5 wherein there is no physical contact between the first and second magnetic materials.

* * * * *

UNITED STATES PATENT AND TRADEMARK OFFICE

CERTIFICATE OF CORRECTION

PATENT NO. : 6,747,233 B1
DATED : June 8, 2004
INVENTOR(S) : Mietek T. Glinkowski It is certified that error appears in the above-identified patent and that said Letters Patent is hereby corrected as shown below:

Column 4,
Line 55, "AMP" should read -- AMF --
Line 62, "ANF" should read -- AMF --

Signed and Sealed this

Ninth Day of November, 2004

JON W. DUDAS
*Director of the United States Patent and Trademark Office*